US010704331B2

(12) United States Patent
Shotwell

(10) Patent No.: US 10,704,331 B2
(45) Date of Patent: Jul. 7, 2020

(54) REAMER FOR USE IN DRILLING OPERATIONS

(71) Applicant: Patrick Patrick Reilly, Aptos, CA (US)

(72) Inventor: Duane Shotwell, Conroe, CA (US)

( * ) Notice: Subject to any disclaimer, the term of this patent is extended or adjusted under 35 U.S.C. 154(b) by 115 days.

(21) Appl. No.: 15/456,415

(22) Filed: Mar. 10, 2017

(65) Prior Publication Data

US 2018/0258703 A1 Sep. 13, 2018

(51) Int. Cl.
*E21B 10/26* (2006.01)
*E21B 10/56* (2006.01)
*E21B 10/46* (2006.01)

(52) U.S. Cl.
CPC ..... *E21B 10/26* (2013.01); *E21B 10/46* (2013.01); *E21B 10/56* (2013.01)

(58) Field of Classification Search
CPC ..... E21B 10/26; E21B 10/46; E21B 10/56
See application file for complete search history.

(56) References Cited

U.S. PATENT DOCUMENTS 3,938,853 A * 2/1976 Jurgens ..... B23P 11/022 175/325.2
5,449,048 A * 9/1995 Thigpen ..... E21B 10/567 175/430
8,607,900 B1 * 12/2013 Smith ..... E21B 10/26 175/323
2008/0264696 A1 * 10/2008 Dourfaye ..... E21B 10/573 175/428
2013/0161099 A1 * 6/2013 Silva ..... E21B 10/26 175/57
2014/0202770 A1 * 7/2014 Zaki ..... E21B 10/26 175/57
2014/0246247 A1 * 9/2014 Smith ..... E21B 10/26 175/394
2016/0123085 A1 * 5/2016 Shotwell ..... E21B 10/26 175/406
2016/0123088 A1 * 5/2016 Shotwell ..... E21B 10/26 175/406
2016/0123089 A1 * 5/2016 Shotwell ..... E21B 10/56 175/406
2016/0186504 A1 * 6/2016 Simpson ..... E21B 17/1078 175/57
2016/0265280 A1 * 9/2016 Shotwell ..... E21B 10/26
2018/0058147 A1 * 3/2018 Shotwell ..... E21B 7/28

* cited by examiner

*Primary Examiner* — Michael R Wills, III
(74) *Attorney, Agent, or Firm* — Patrick Reilly

(57) ABSTRACT

The invention relates to reamers used in downhole oil well operations, particularly in reaming while drilling applications. Presented is a reamer having an interior channel which runs axisymmetric to an elongate axis of the entire body of the reamer, wherein there are openings along both ends of the reamer, exposing the interior channel. Additionally presented in the reamer are a plurality of paths extending parallel to the interior channel along the exterior of the body of the reamer, and running in a helical pattern along the entirety of the exterior of the body of the reamer. Disposed within the helical paths are a plurality of cutting inserts, which cutting inserts are enabled to provide a uniform cutting surface against a well bore, which preferably improves cutting action and reduces strain on the reamer.

23 Claims, 13 Drawing Sheets

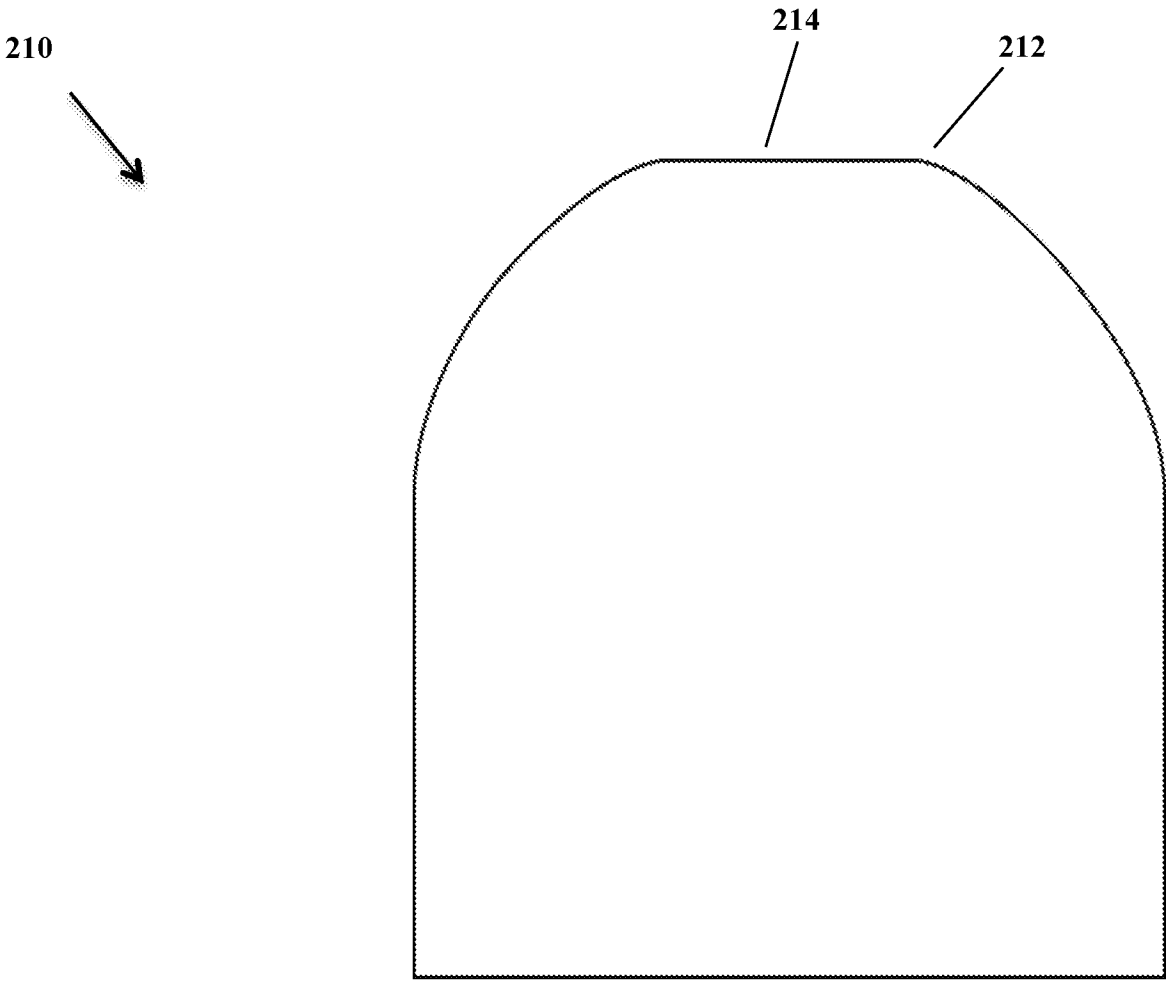
FIGURE 2A – PRIOR ART

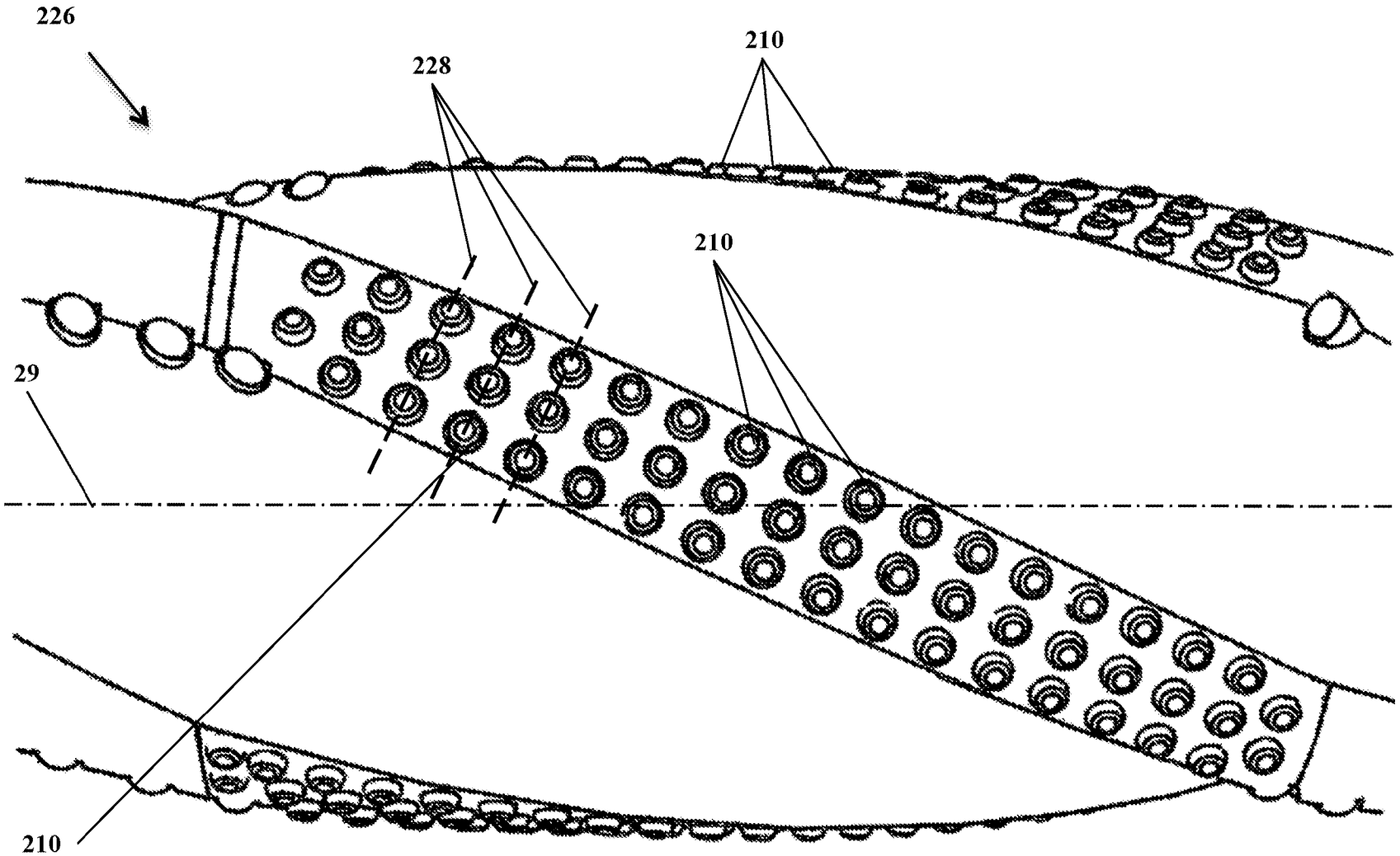
FIGURE 2D – PRIOR ART

FIGURE 3A – PRIOR ART

FOUR BLADES

SIX BLADES

REAMER FOR USE IN DRILLING OPERATIONS

FIELD OF THE INVENTION

The present invention relates to a drilling apparatus for use in the oil industry. More particularly, the present invention relates to a reamer for use in oil well drilling operations.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Wellbore reamers are known in the field of oil well drilling operations, and are used to open wellbores to allow for smooth operation of a drilling string. For example, U.S. Pat. No. 8,607,900 to Smith discloses a bi-directional reamer. Similarly, European Patent Application No. EP1811124 by Bassal, et al. discloses a similar type of bidirectional reamer.

While they are useful tools, these types of reamers have maintenance requirements that can result in increased costs in drilling. Wear and tear on the cutters or the tool body can result in effective failure of the tool, which can then require pulling the drill string to replace the reamer. Some wear of the cutting bits on a reamer is expected, but the rate of wear can be exacerbated by the configuration of the tool. For example, the configuration of the blades on a reamer may direct drilling fluid away from, rather than over, the cutting elements, resulting in excessive wear due to heating. Thus, it is desirable to provide improved fluid flow over the cutting elements of a reaming tool by improving the placement and positioning of the cutting elements relative to a body of the reaming tool, and the angle at which the cutting elements of the reaming tool interact with the wellbore in a drilling operation.

Additionally, current reaming-while-drilling tools utilize flat cap tungsten carbide inserts as the primary cutting elements on the cylindrical outer diameter. It is desirable to provide an improved cutting element design and material formulation to provide such a tool with greater efficiency. Similarly, current reamer designs place the tungsten carbide cutting inserts in simple rows and columns, which does not provide uniform distribution of the carbide against the hole wall. It is desirable to provide a reamer that aligns the cutting inserts so that there is more uniform coverage of the blade width, for example by providing helical cutting blades, positioned in close proximity to one another. It is desirable to provide a reamer with an improved blade design, over currently used helical blades for purposes of improving fluid flow over the cutting inserts.

Current reamer designs also provide polycrystalline diamond cutting inserts (hereinafter, "PDC inserts") along portions of the blades. However current designs fail to balance the load on these cutters. It is thus desirable to allow for the implementation of back rake and side rake with PDC cutting inserts in order to balance the extremely heavy and cumbersome burdens and forces placed on the cutter. Providing such back rake and side rake improves drilling efficiency by providing better force balancing and load work distribution of the cutters regardless of their position.

There is therefore a long-felt need to provide a reaming tool with increased efficiencies in cutting insert size, composition, placement, and design.

SUMMARY OF THE INVENTION

Towards these objects and other objects that will be made obvious in light of the present disclosure, a reaming tool is presented which implements a unique blade design and preferably an improved cutting element design. The present invention (hereinafter, "the invented tool") preferably comprises at least two blades.

A first preferred embodiment of the invented reaming tool preferably comprises a tool body with a plurality of cutting inserts extending outward from the tool body. For drilling operations, the tool body comprises an annular opening having a top open end and a bottom open end, and positioned axisymmetrically about a central elongate axis, through which drilling fluid is pumped downhole, through the drillstring to the drill bit. Drilling fluid returns uphole along the exterior of the drillstring, providing lubrication and cooling in drilling operations. The positioning of the cutting inserts, as described herein, provides increased efficiencies in the means by which lubrication is provided to the drillstring in drilling operations.

According to the method of the present invention (hereinafter, "the invented method") at least two or more blades are located on an external side of the tool body and extend in a helical or spiral shape about the central elongate axis of the tool body. The blades of each preferred embodiment of the invented tool in combination preferably extend a full 360 degrees or more around a circumference of the tool body in a plane that is normal to the central elongate axis, whereby fluid and debris may transit between the blades and the cutting inserts may optionally be positioned to provide in combination a full 360 degrees or more around the circumference of the tool body in a plane that is normal.

It is understood that in certain other alternate preferred embodiments of the invented tool that the blades of a particular preferred embodiment of the invented tool may be sized and positioned to in combination preferably extend more than 360 degrees around a circumference of the tool body in a plane that is normal to the central elongate axis, whereby fluid and debris may transit between the blades and the cutting inserts may optionally be positioned to provide in combination more than 360 degrees around the circumference of the tool body in a plane that is normal.

In certain alternate preferred embodiments of the invented tool, each blade of a particular embodiment of the invented tool is substantively equally shaped as each other blade of the same embodiment of the invented tool, wherein each of said blades is preferably sized to be within 5% of each dimension of every other blade of a same embodiment of the invented tool.

The reamer additionally preferably comprises two or more cutting inserts, wherein the cutting inserts are disposed along the exterior of the annular body. The cutting inserts of the present invention rise from either end of the reamer in a helical manner, forming a helical section parallel to the annular body between the tapered ends, wherein the helically positioned cutting inserts lay in very close proximity to one another, preferably spaced in such a way that the view of the cutting inserts is uninterrupted along an axial view of the reaming tool. In one preferred embodiment of the present invention, the helical portion of the cutting inserts comprise tungsten carbide inserts of a unique design. The cutting inserts are preferably approximately 25%-50% larger in diameter than standard inserts and provide a flat-topped design with an interior channel, rather than, as with inserts currently in use, having partially rounded, solid tops. Additionally, the total size of the cutting inserts is preferably chosen in view of the blade width and size of the reamer body on which the inserts are mounted and the selected displacements between cutting inserts as arranged on the reamer body. The placement of the cutting inserts about the interior channel and the central elongate axis in very close proximity results in a more uniform distribution of the carbide against the hole wall and also provides additional cutting edge surface against a surface of a hole wall in drilling operations. It is understood that the invented method enables a selected size and quantity of inserts to be determined in view of the size of a selected reamer and the qualities and nature of formations being drilled, i.e., the severity of an intended application of the particular reamer.

PDC cutting inserts are provided along the tapered, linear portions of the blades. The PDC cutting inserts may be mounted with back rake or side rake (or both) to increase cutting efficiency and improve load distribution on these cutters. Optionally or additionally, tungsten carbide inserts (hereinafter, "TCI inserts") may be positioned on blade lengths and positioned between the two tapered, linear portions of the comprising blade.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

These, and further features of the invention, may be better understood with reference to the accompanying specification and drawings depicting the preferred embodiment, in which:

FIG. 2A is a schematic side view of a prior art tungsten carbide cutting insert;

FIG. 2D is a schematic of a typical carbide cutting element surface distribution across the face of a typical prior art reaming tool;

FIG. 3A is a graphical plot of carbide cutting element surface distribution across the face of a prior art reaming tool;

DETAILED DESCRIPTION

Figure 1A:
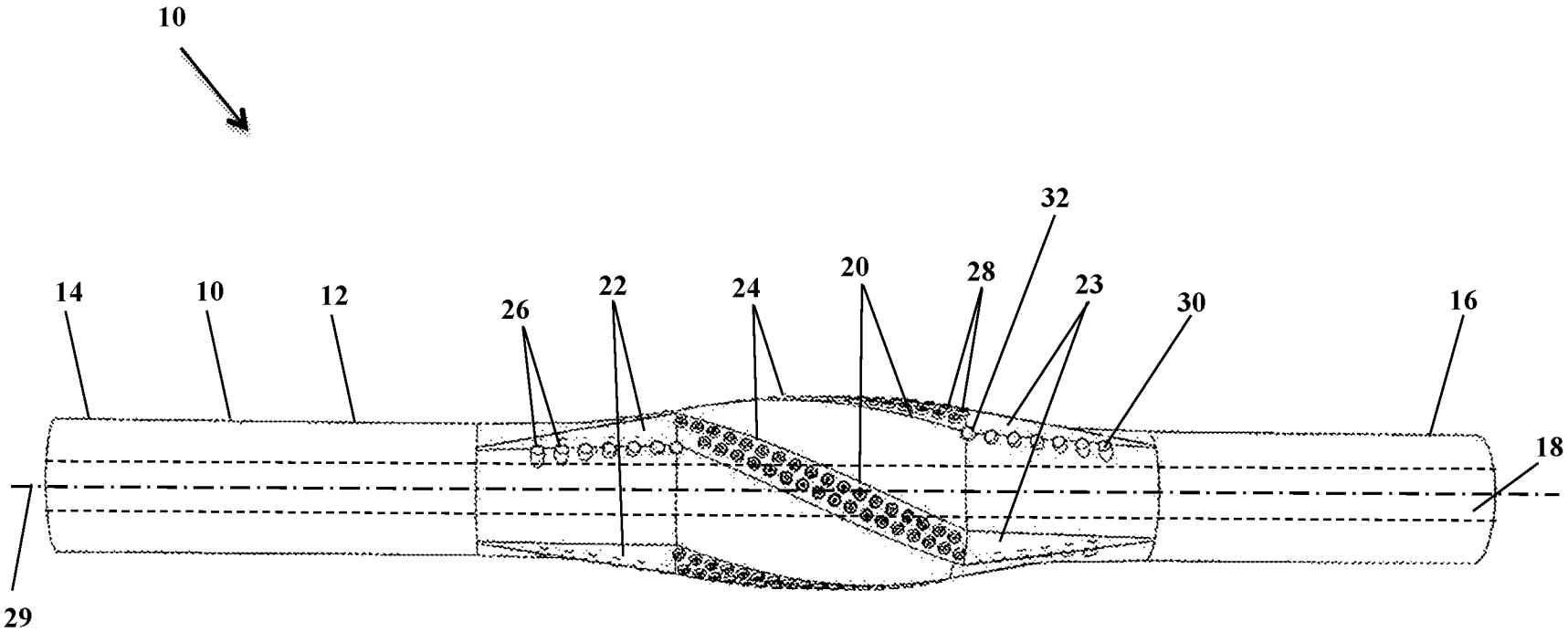
FIG. 1A is a side view of one embodiment of the present invention.

Referring now to FIG. 1A, FIG. 1A shows a first preferred embodiment of the present invention reamer 10 (hereinafter, "the invented reamer" 10). The invented reamer 10 comprises a reamer body 12 having a first end 14, a second end 16, an interior channel 18, and a plurality of cutting blades 20. The first end 14 of the invented reamer 10 is preferably positioned in use "uphole," that is, closer to the surface via a borehole (not shown) as known in drilling operations than the second end 16 of the invented reamer 10, which is preferably positioned "downhole" in use, i.e. further from the surface in a borehole. Drilling fluid is pumped downhole through the interior of the drilling string, flows through the axisymmetrically disposed invented reamer 10, through the interior channel 18, and exits the invented reamer 10 at the second end 16. As it returns uphole, the drilling fluid flows over the exterior of the invented reamer 10, providing lubrication and cooling for the cutting blades 20 (hereinafter, "blades" 20).

Each of the blades 20 comprises a first linear tapered section 22 and a second linear tapered section 23 which rise from the reamer body 12 to the desired cutting radius, and a constant radius helical section 24. The desired maximum outer radius of the helical section 24 is preferably within the range of ⅛ inch to ½ inch smaller than the bore in which the invented reamer 10 is used. The PDC inserts 26 preferably comprise PDC cutting material, but may be composed of any suitable material known in the art, are arrayed along the first and second linear tapered sections 22, 23. The TCI inserts 28 preferably comprise, but are not limited to, tungsten carbide cutters, and are arrayed on the helical sections 24 about a central elongate tool centerline axis 29 (hereinafter, "the tool centerline" 29). The tool centerline 29 extends through the interior channel 18 of the invented reamer 10, through the first end 14 and the second end 16 of the reamer body 12. The blades 20, the PDC inserts 26 (hereinafter, "the PDC inserts" 26), and the inserts 28 (hereinafter, "the TCI inserts" 28) are positioned relative to the tool centerline 29.

The linear form of first and second linear tapered sections 22 & 23 provide improved cleaning and cooling of the cutting elements arrayed thereon, because circulating fluid is forced directly over these cutting elements. Those of skill in the art will recognize that the arrangement of the PDC inserts 26 and the TCI inserts 28 will allow the invented reamer 10 to ream a borehole regardless of whether the invented reamer 10 is moving uphole or downhole. Additionally, the PDC inserts 26 may be mounted with back rake, side rake, or both to increase cutting efficiency. (See FIG. 1A) Preferably, a plurality of PDC inserts 26, 30 & 32 are mounted with increasing back and side rake (relative to each other) such that a first PDC insert 30 of the plurality of PDC inserts 26, 30 & 32 is mounted closest to the reamer body 12 and a cutter element height linearly increases from the downhole end toward the spiral section and a last PDC insert 32 is of the plurality of PDC inserts 26, 30 & 32 is mounted furthest from the reamer body 12. The plurality of PDC inserts 26, 30 & 32 and the TCI inserts 28 are preferably placed about the tool centerline 29 such that, when viewing the invented reamer 10 from a view point looking along the tool centerline 29, an uninterrupted series of the plurality of PDC inserts 26, 30 & 32 and TCI inserts 28 are presented along the reamer body 12 of the invented reamer 10.

Additionally, fewer maintenance costs will be necessary, as the force of the drilling operation is spread across a greater number of the plurality of PDC inserts 26, 30 & 32 and TCI inserts 28, thus reducing the wear and tear on each individual plurality of PDC inserts 26, 30 & 32 and TCI insert 28.

Figure 1B:
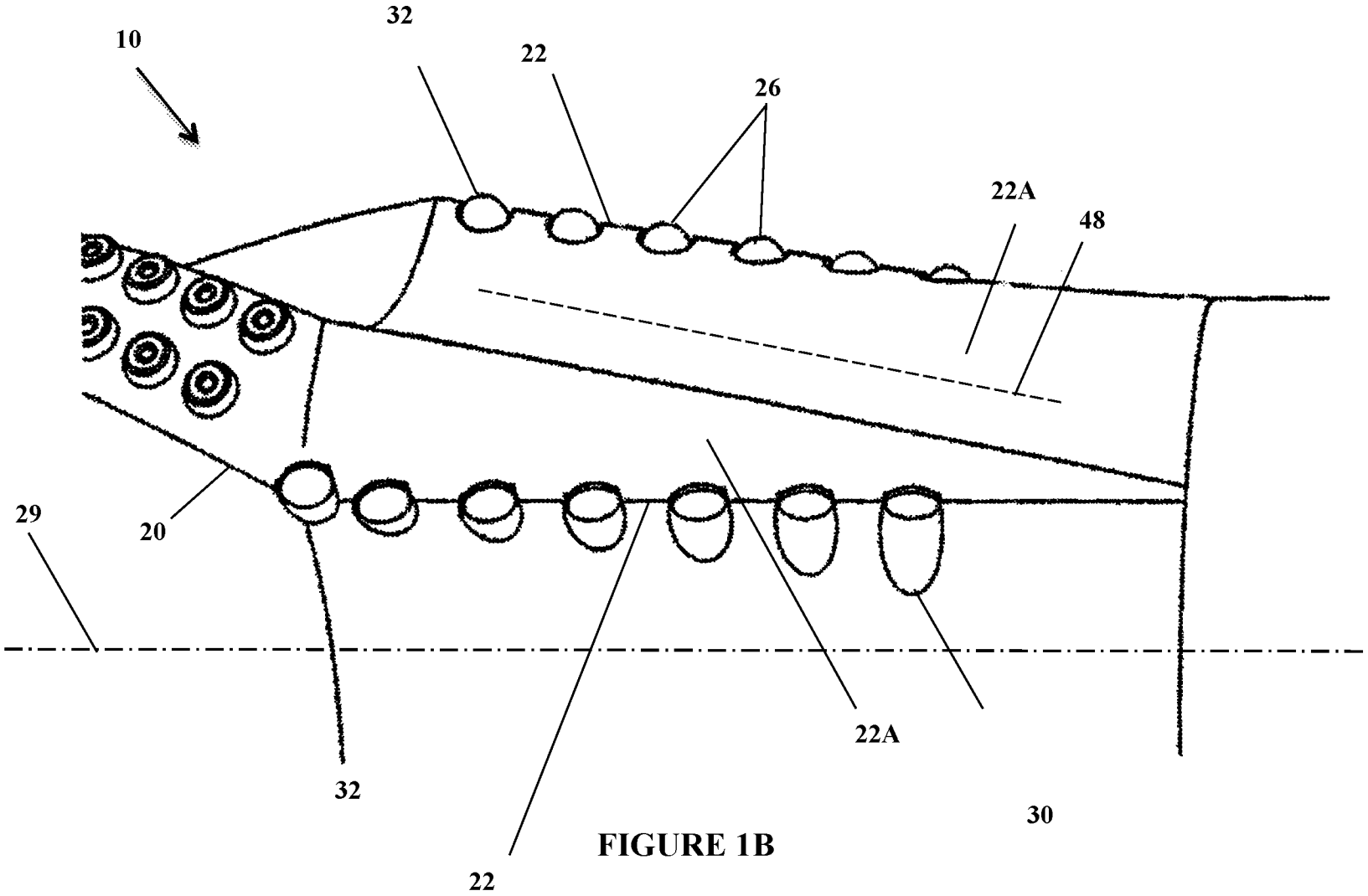
FIG. 1B is a plan view of a linear tapered section of FIG. 1, detailing the mounting of cutting elements thereon with back or side rake.

Referring to FIG. 1B, FIG. 1B shows a linear tapered section 34, which corresponds to one of the linear tapered sections 22 or 23 of FIG. 1. The PDC inserts 26, 30 & 32 are mounted thereon, and may be mounted with back rake. Optionally, the PDC inserts 26, 30 & 32 may be mounted with a combination of back rake and side rake.

In a preferred embodiment of the present invention, the plurality of PDC inserts 26, 30 & 32 are mounted with an increasing degree of back rake and side rake as a surface 22A of the exemplary first linear tapered section 22 rises away from the reamer body 12.

It is understood that the word "exemplary" is used herein to mean "serving as an example, instance, or illustration." Any aspect described herein as "exemplary" is not necessarily to be construed as exclusive, preferred or advantageous over other aspects.

Mounting the plurality of PDC inserts 26, 30 & 32 in this fashion allows for an improved balance of cutting action and reduced cutter wear. Those of ordinary skill in the art will recognize that, if the plurality of PDC inserts 26, 30 & 32 are mounted with an "interference fit" as is common in prior art cutters, contact with the well bore can, and probably will, cause the plurality of PDC inserts 26, 30 & 32 to rotate or shift within their mounting holes, altering the back or side rake of the plurality of PDC inserts 26, 30 & 32 and defeating the goal of the original mounting positions. For this reason, it is preferred that the plurality of PDC inserts 26, 30 & 32 are mounted by brazing them into their desired positions, such that the will remain fixed securely in their positions throughout an operation.

Figure 2C:
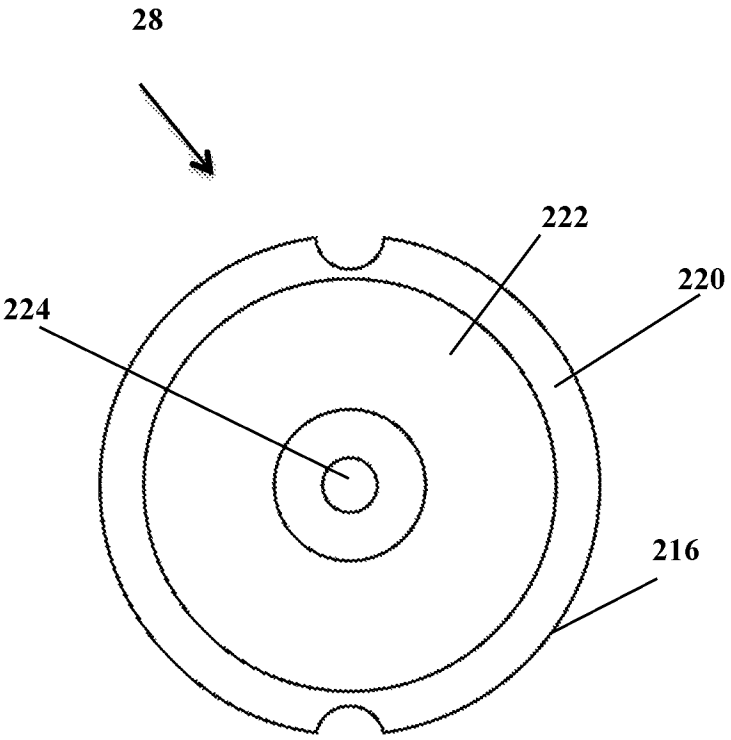
FIG. 2C is a schematic top view of a tungsten carbide cutting element of the present invention of FIG. 1A.
Figure 2B:
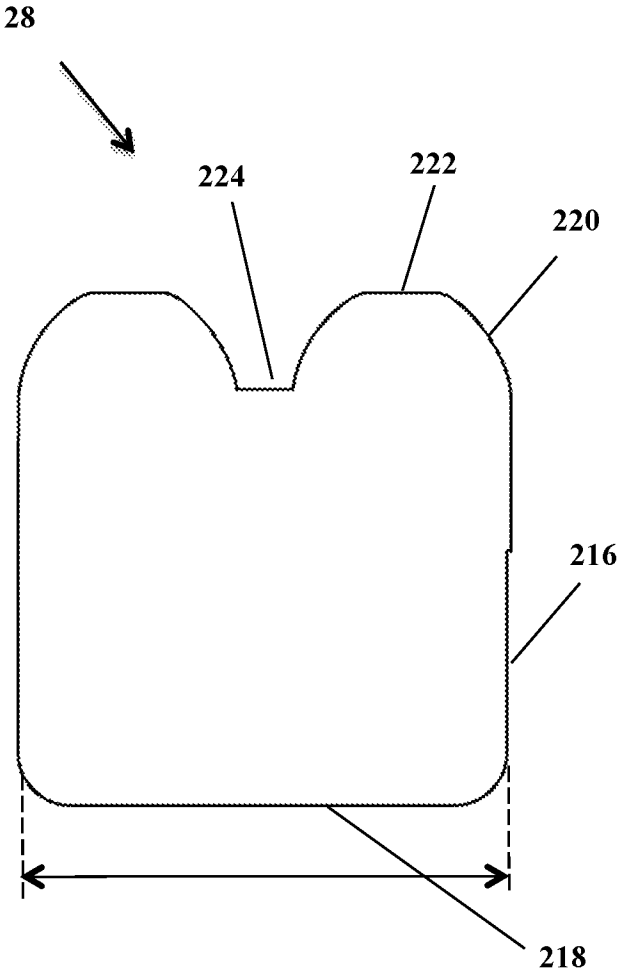
FIG. 2B is a schematic cross-sectional side view of a tungsten carbide cutting insert of the present invention of FIG. 1A.

Referring to FIGS. 2A, 2B, and 2C, FIG. 2A shows a prior art tungsten carbide cutter 210, as shown in FIG. 2A, as compared to the preferred TCI insert 28 of the present invention, as shown in FIGS. 2B and 2C. Typical prior art tungsten carbide cutters 210 (hereinafter, "prior art TCI inserts" 210), as shown in FIG. 2A, characteristically provide angled sides 212 leading to a flat top 214. In patentable distinction, the invented TCI insert 28 of the invented method, as shown in FIG. 2B and FIG. 2C, provides a circular sidewall 216 leading from a flat base 218 to angled sides 220 that further extend to a flat top 222, but additionally provides a depression 224 in the center of each of the invented TCI inserts 20. This depressed design allows the TCI insert 28 to be larger than prior art TCI inserts 210, because the depression 224 in each invented TCI insert 28 makes the invented TCI insert 28 less likely to break, even with great surface area interacting with the wellbore. The invented TCI inserts 28 also provide additional cutting edges and allowing for a more uniform and efficient carbide cutting surface.

Referring to FIG. 2D, in FIG. 2D typical distributions of prior art TCI inserts 210 of a prior art reaming tool 226 and the invented reamer 10 of the present invention, respectively, are shown. As reflected in FIG. 2D, the prior art reaming tool 226 may comprise a plurality of prior art TCI inserts 210 arrayed in effectively linear (or helical), evenly spaced rows 228, resulting in a carbide cutter distribution across the cutting face of the prior art reaming tool that presents areas of higher and lower low carbide coverage in the surface distribution of the effective cutting surface, wherein said surface distribution is known in the art to be the height of the effective cutting surface relative to the surface of the prior art blade 230 on which the prior art TCI inserts 210 are mounted. Such an evenly spaced, but relatively distant distribution of prior art TCI inserts 210 along the effective cutting surface results in uneven and excessive wear to the prior art TCI inserts 210, as well as non-uniform reaming of the well bore (not shown).

Figure 2E:
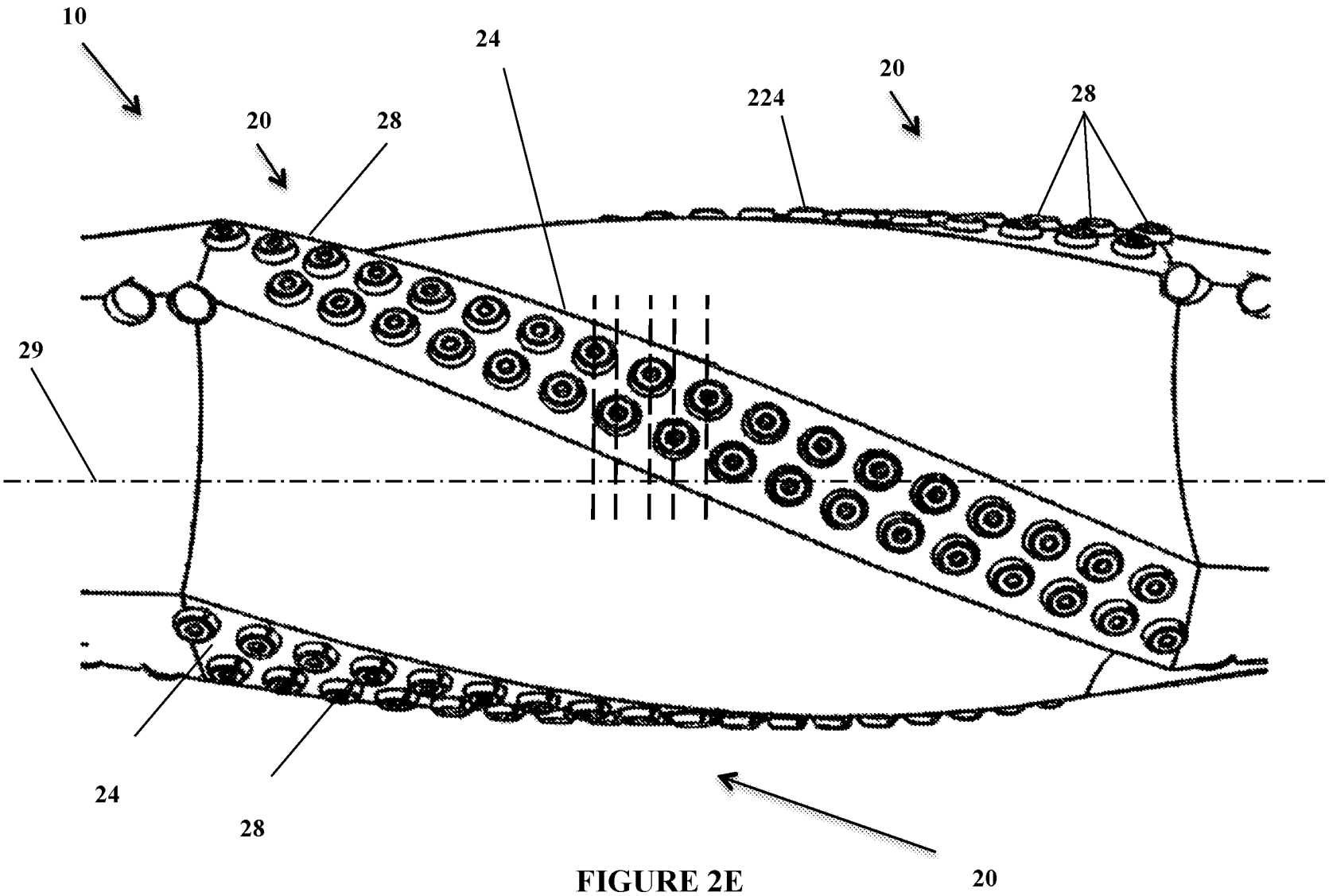
FIG. 2E is a schematic representation of the placement of tungsten carbide cutting elements of the present invention of FIG. 1A.

Referring to FIG. 2E, FIG. 2E schematically demonstrates the preferred arrangement of the invented TCI inserts 28 upon the invented reamer 10. Rather than being arranged in simple rows and columns as is conventional in reaming tools currently in use, the TCI inserts 28 are preferably arranged along uniformly spaced cutter insert centers within the constant radius helical sections 24 of each the blade 20 of the invented reamer 10 so that there is a substantially uniform distribution (dashed lines are provided for illustration) of the cutting surface around the circumference, not shown in FIG. 2E, of the invented reamer 10. It is understood that the circumference of the invented reamer 10 is measured within a plane normal to the tool centerline 29.

Figure 3B:
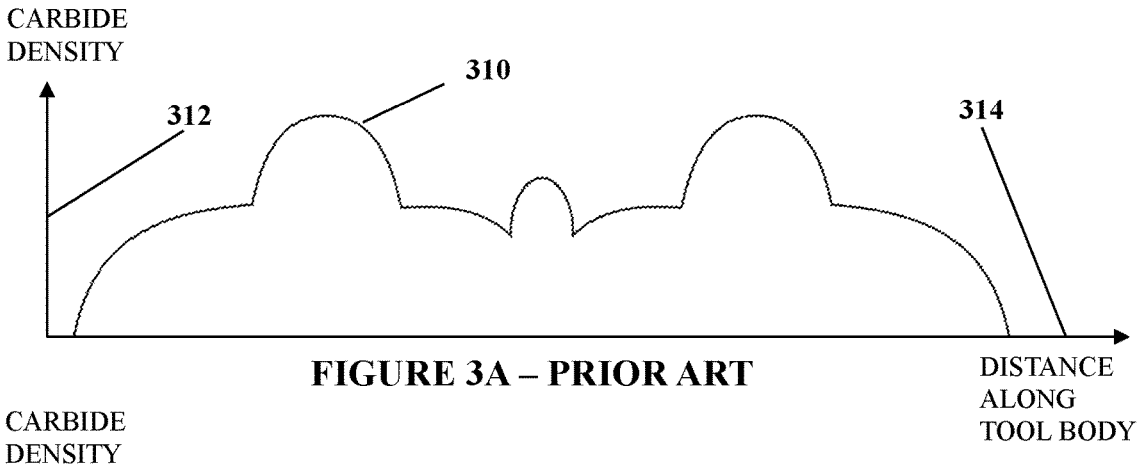
FIG. 3B is a graphical plot of carbide cutting element surface distribution across the face of a prior art reaming tool but using the placement scheme of the present invention of FIG. 1A.
Figure 3B:
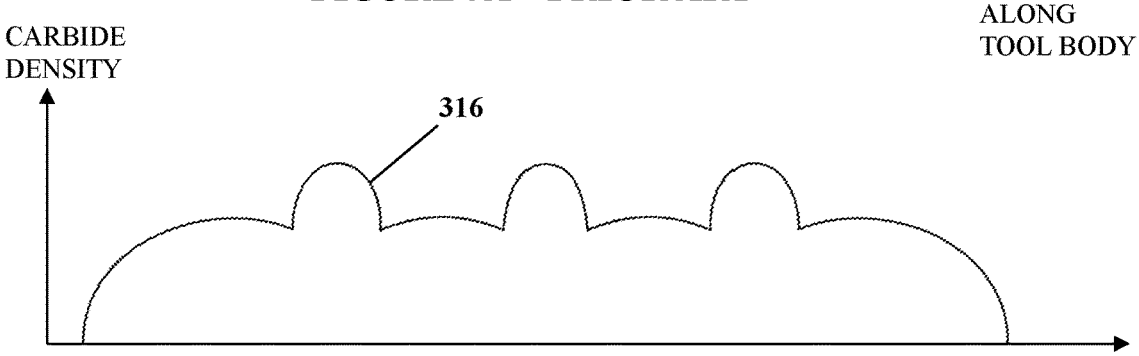

As reflected in FIGS. 3A, 3B, 3C, and 3D, the novel distribution of the TCI inserts 28 of the invented reamer 10 as shown in FIG. 2E provides a more uniform cutting surface against the well bore (not shown), which will improve cutting action and reduce strain on the invented reamer 10. FIG. 3A presents a plot 310 of the carbide density 312 down the length of the reamer body 314 for a prior art tool, including prior art TCI inserts 210 and a prior art cutting element distribution scheme. As reflected in plot 310, the carbide density along a prior art reaming tool 226 can vary tremendously, resulting in uneven cutting and wear on the tool, as well as on the drill string.

FIG. 3B presents a plot 312 of carbide density for the same prior art TCI inserts 210, but utilizing the distribution scheme of the present invention of FIG. 2E. In comparison to FIG. 3A, significantly fewer variations in carbide density are seen, but the variations which are presented are still significant.

Figure 3C:
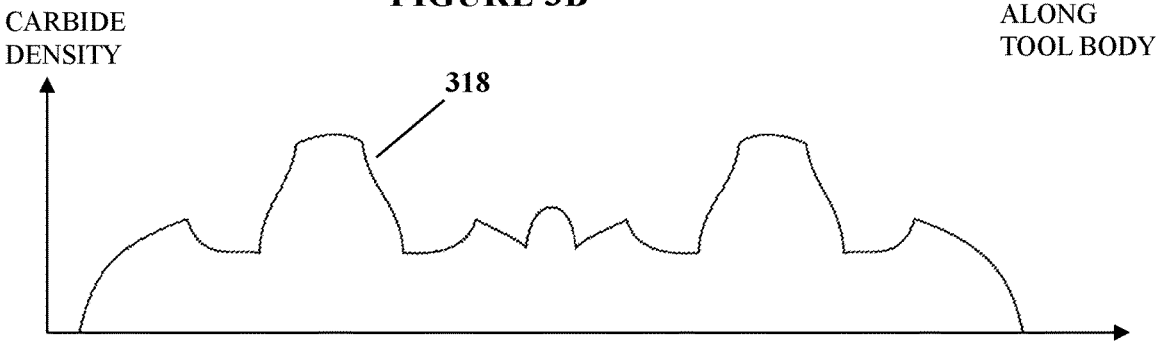
FIG. 3C is a graphical plot of carbide cutting element surface distribution across the face of a reaming tool using the cutting elements of the present invention of FIG. 1A but in a standard placement scheme.

FIG. 3C presents a plot 314 of carbide density for a reaming tool using the TCI inserts 28 (FIGS. 2B and 2C), but with the prior art distribution scheme of FIG. 3A. The use of the cutting elements of the present invention provides some improvement over the prior art due to the additional cutting surfaces provided.

Figure 3D:
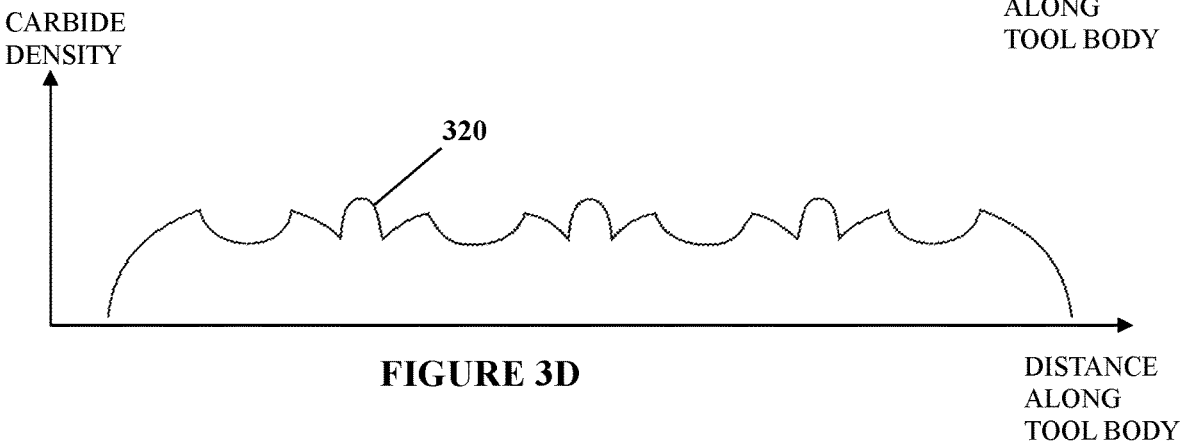
FIG. 3D is a graphical plot of carbide cutting element surface distribution across the face of the reamer of the present invention of FIG. 1A; arc length contribution of the exemplary blade width.

FIG. 3D presents a plot 316 of carbide density for the invented reamer 10 of the present invention, using both the TCI inserts 28 and the improved distribution scheme of FIG. 2E. As reflected in FIG. 3D, the variance in the carbide density distribution is significantly reduced over the prior art, i.e. if a horizontal slice is taken through the blade 20 and the amount of carbide on the surface of the blade 20 in that slice is calculated as a function of the blade width (or hole circumference) the amount varies widely with prior art cutters. The calculated percentage of amount of carbide in the surface vs. the width of the blade can range from 0% to 100% across a blade 20. The present invention tries to minimize the standard deviation from the mean or average carbide density.

The preferred distribution of the cutting elements may be determined empirically, such as by using a spreadsheet to graphically display the carbide cutter placement on the blade 20 of the invented reamer 10, resulting when varying factors such as the outside diameters of each PDC insert 26, 30 & 32 and TCI insert 28 and, in invented reamer 10, the diameter of the depression 222, as shown in FIGS. 2B and 2C, in the TCI inserts 28. In a preferred embodiment, the variation in the carbide distribution will vary no more than +/−15% of the median carbide distribution (as a function of the width of the blade 20 measured at an outer diameter of the invented reamer 10.

For example, if the average carbide distribution is 50%, the preferred range of carbide cutter distribution would be 35% to 65%. Those of skill in the art will understand that the distribution of the TCI inserts 28 on each of the blades 20, as shown in FIG. 1A, need not be identical, and may be varied as needed to provide an effectively uniform carbide cutting surface against the well bore.

Figure 4A:
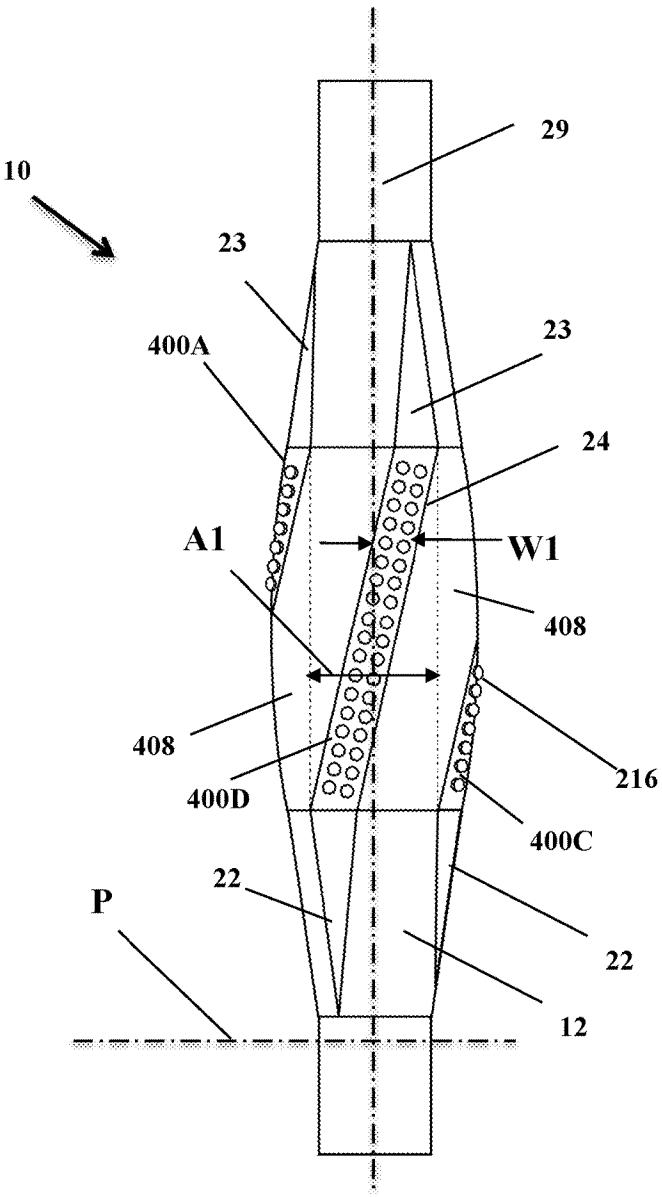
FIG. 4A is an additional side view of the four-bladed embodiment of the invented reamer of FIG. 1A, wherein arc length distinctions are denoted.
Figure 4B:
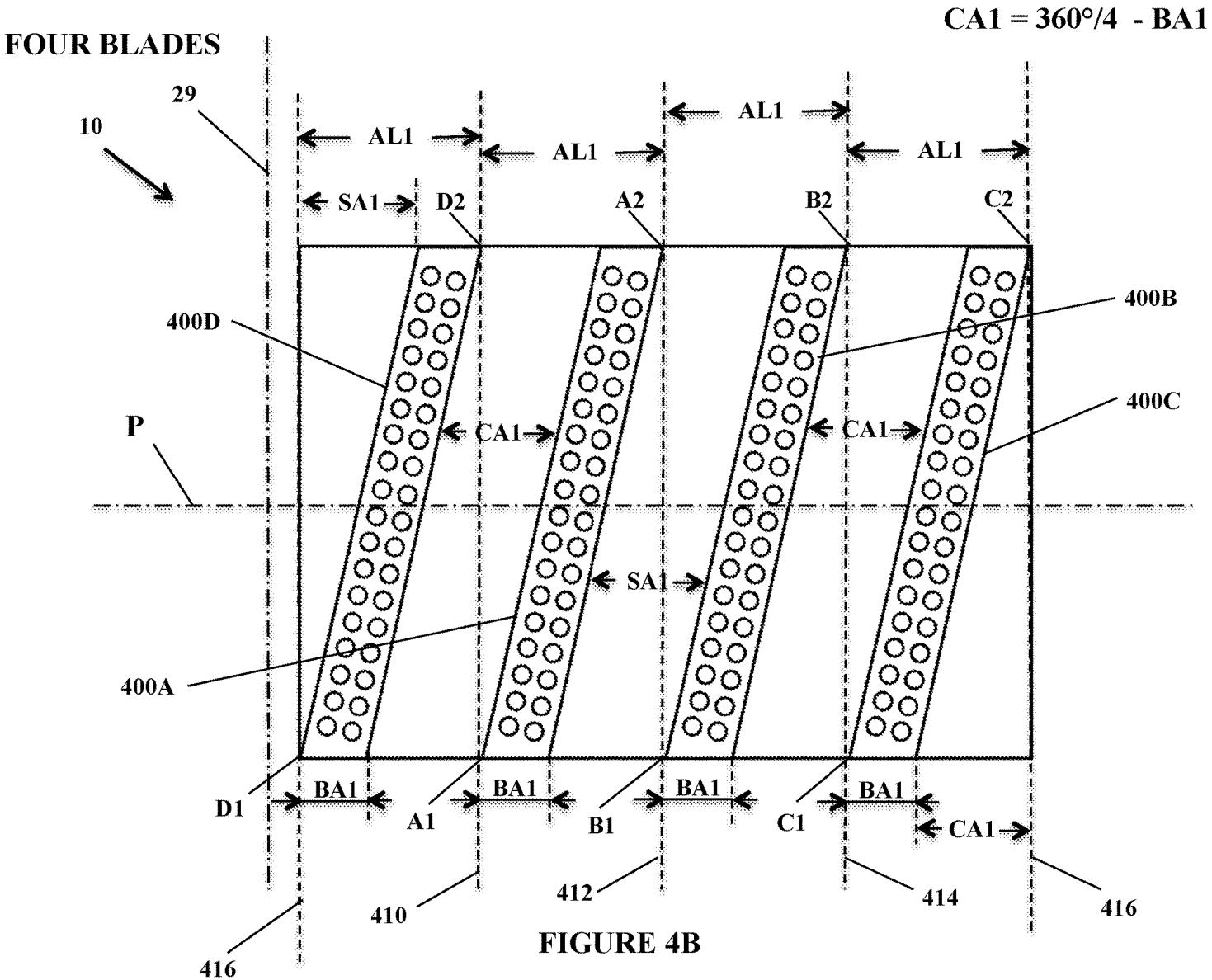
FIG. 4B is a representation of a projection view of the surface of the alternate four-bladed embodiment of the invented reamer of FIG. 1A and FIG. 4A.
Figure 4C:
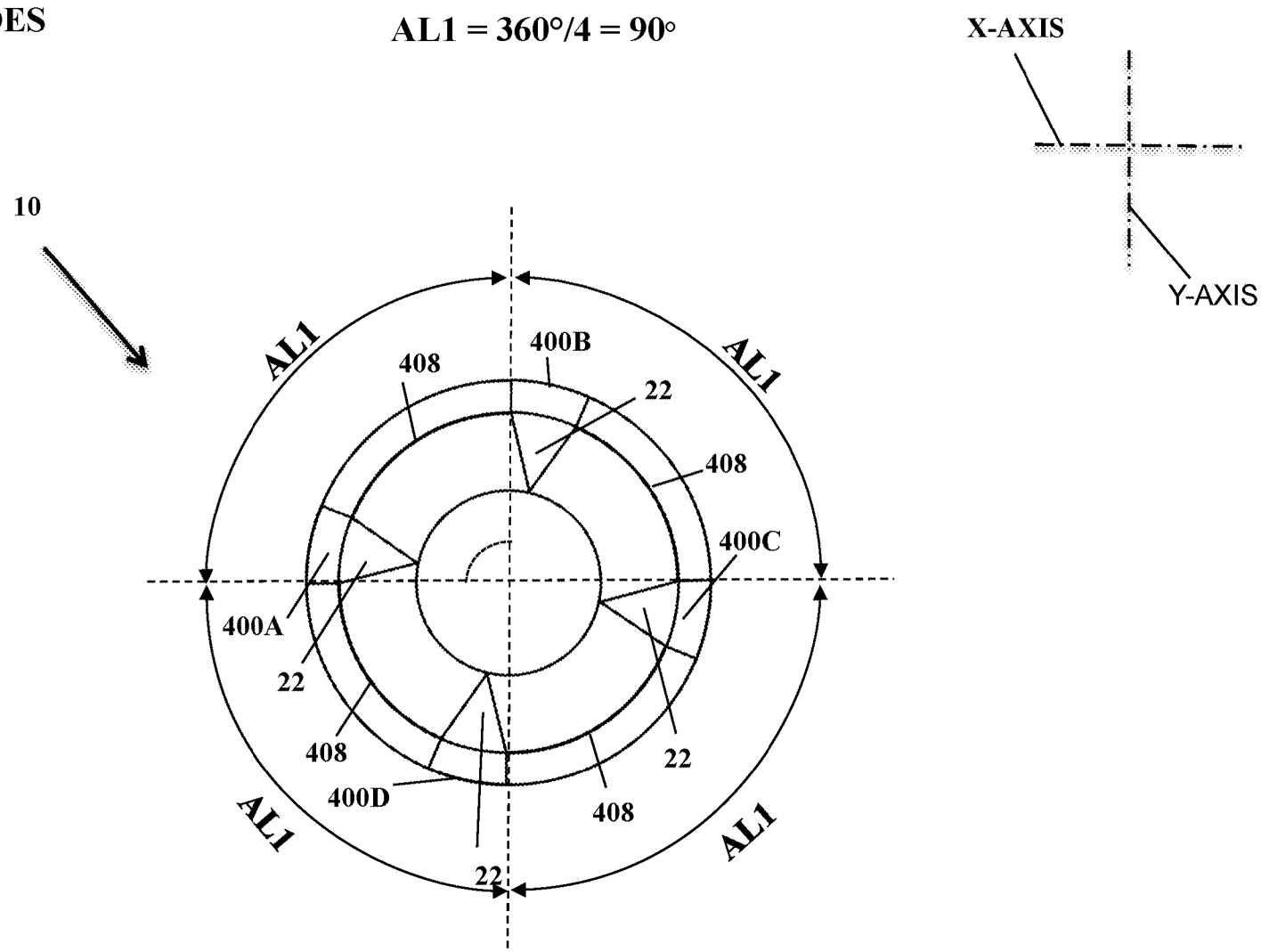
FIG. 4C is a cut-away top view of the invented reamer of FIG. 1A and FIG. 4A, wherein arc length distinctions are again denoted.
Figure 5A:
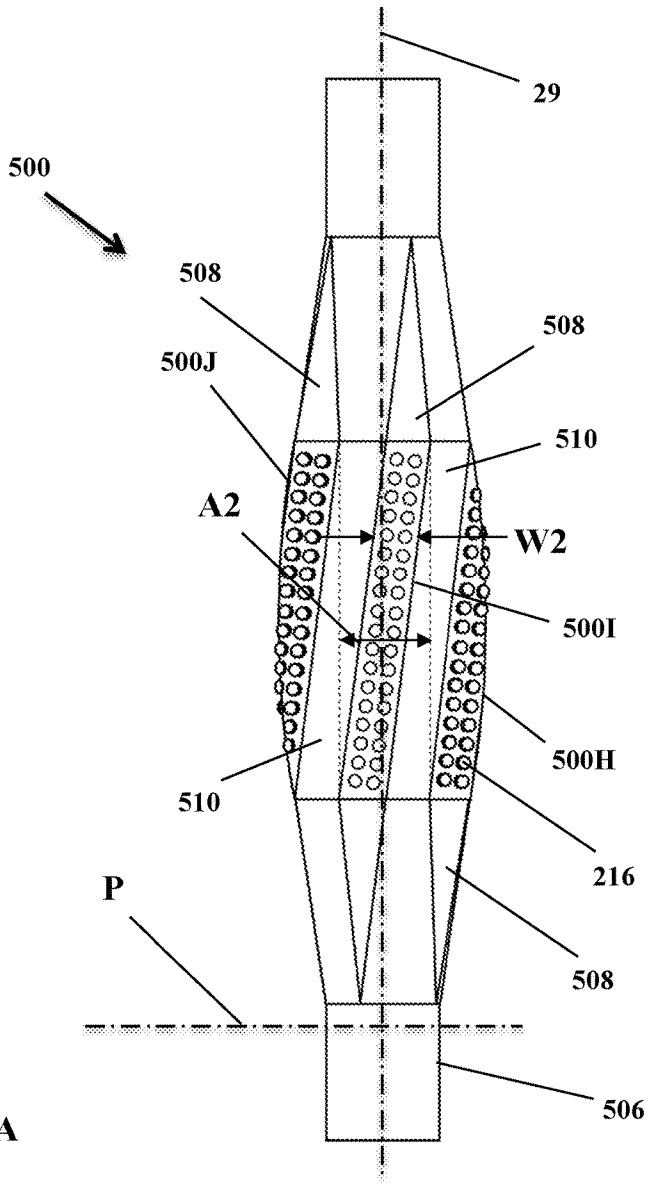
FIG. 5A is a side view of an alternate six-bladed embodiment of the invented reamer of FIG. 1A comprising six alternate blades (hereinafter, "six-bladed invented reamer"), wherein the full arc length of an exemplary blade is denoted.
Figure 5B:
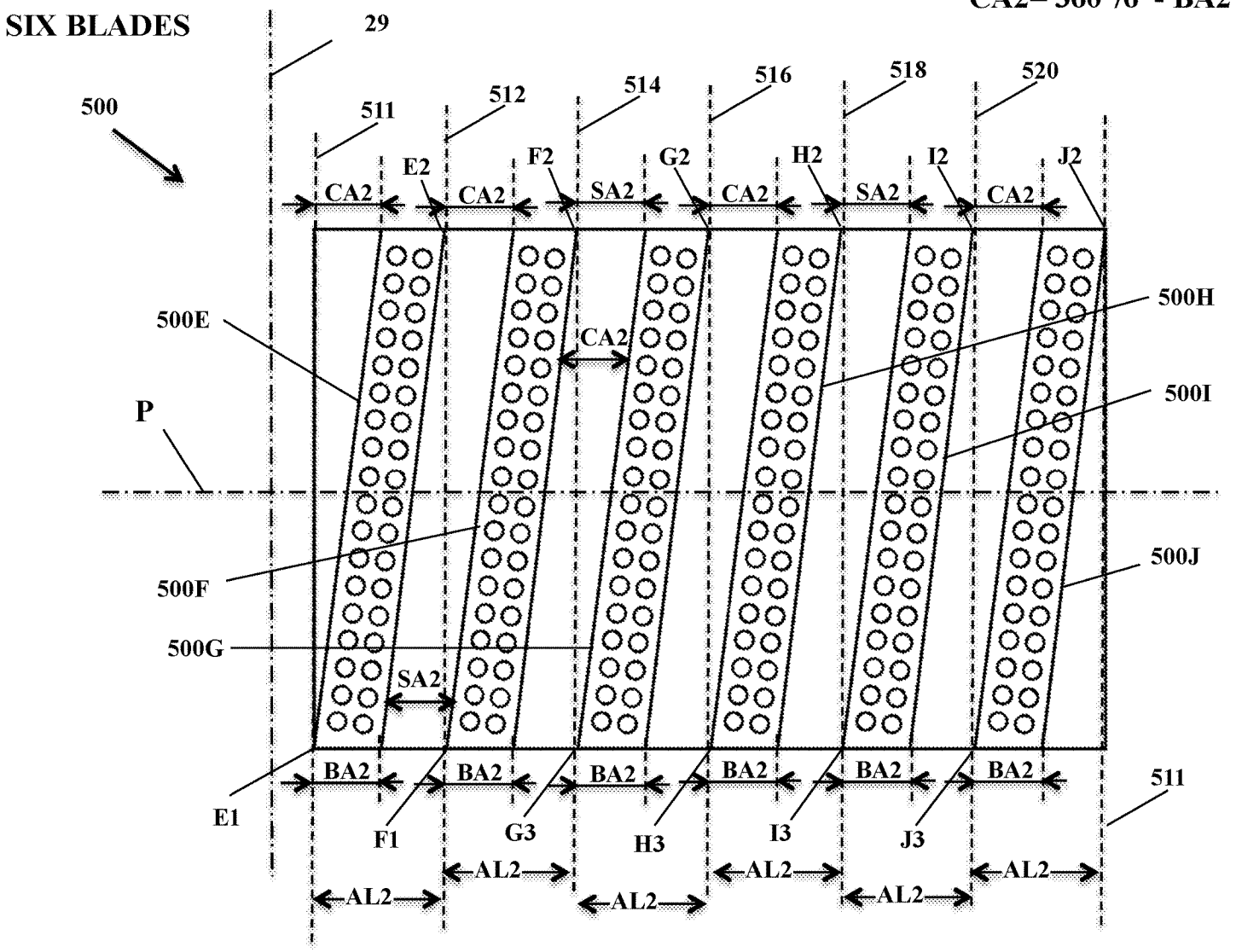
FIG. 5B is a cut-away top view of the six-bladed invented reamer of FIG. 5A, wherein the exemplary full arc length contribution of the exemplary blades of FIG. 5A is further denoted.
Figure 5C:
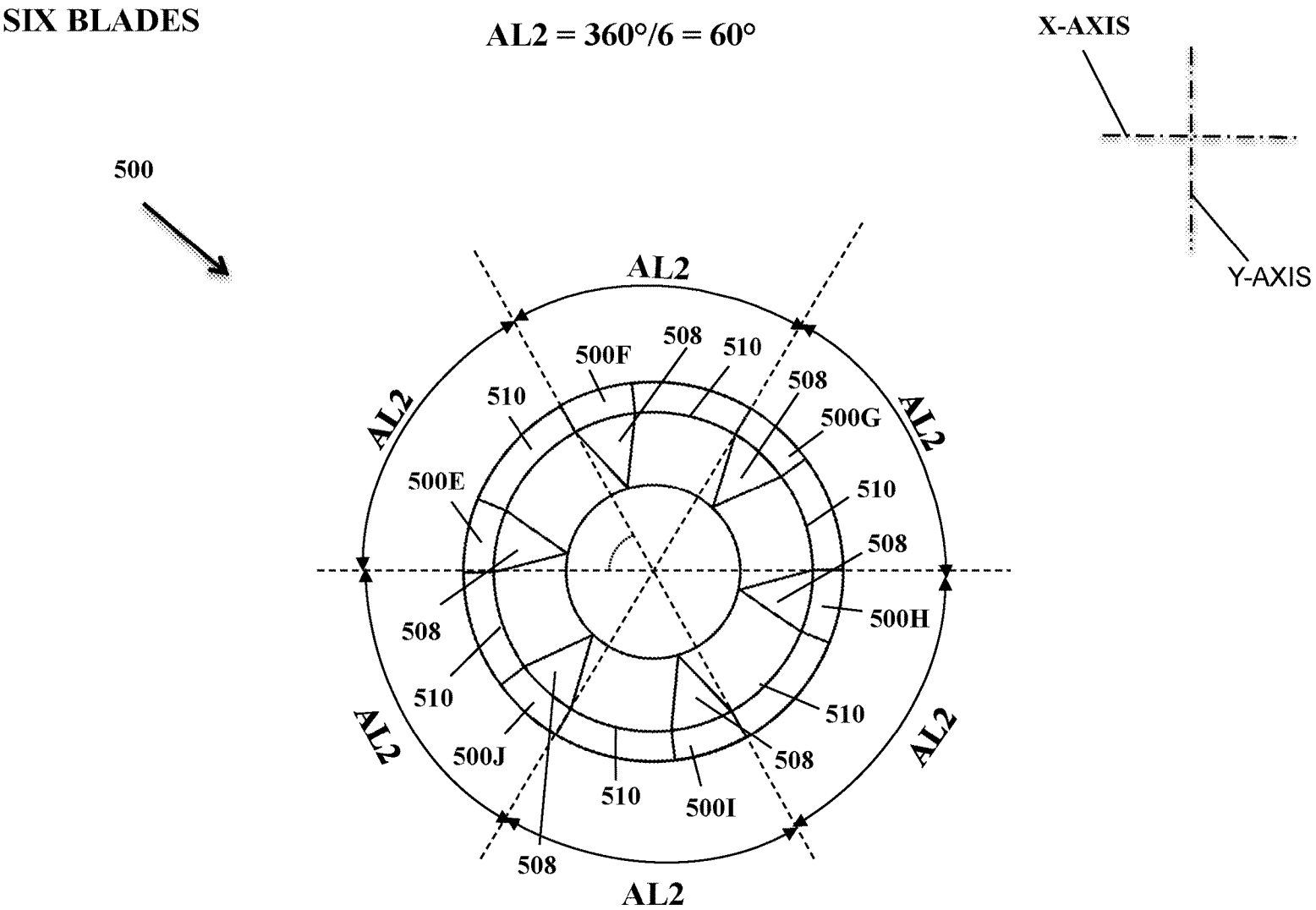
FIG. 5C is a representation of a projection view of the surface of the alternate six-bladed embodiment of the invented reamer of FIG. 4A.

Referring now generally to the Figures and particularly FIG. 4A through FIG. 5C, the invented four-bladed reamer 10 is presented in FIG. 4A through FIG. 4C and an invented six-bladed reamer alternate as presented in FIG. 5A through FIG. 5C.

Referring now generally to the Figures and particularly to FIG. 4A through FIG. 5C, two separate and distinct variations of the annular invented reamer 10 & 500 respectively comprise a plurality of at least four exemplary blades 400A-400D (hereinafter, "exemplary blades" 400A-400D) or a plurality of six alternate blades 500E-500J, (hereinafter, "alternate blades" 500E-500J) are respectively located on an exterior of selected annular tool bodies 12 and 506. In each configuration of FIG. 4A through FIG. 5C each observed exemplary blade 400A-400D and alternate blade 500E-500J of a particular embodiment of the invented reamer 10 & 500 is substantively equally shaped as each other blade 400A-400D & 500E-500J of the same comprising embodiment of the invented reamer 10 & 500, wherein each of said blades 400A-400D & 500E-500J is preferably sized to be within 5% of each dimension of every other blade 400A-400D & 500E-500J of a same comprising embodiment of the invented reamer 10 & 500.

In accordance with the invented method, it is preferred that each combination of exemplary blades 400A-400D and alternate blades 500E-500J of each tool body 12 & 506 will in combination extend at least 360 degrees around the tool centerline 29. In the presented preferred embodiment of the invented four-bladed reamer 10 of FIG. 4A through FIG. 4C, each exemplary blade 400A-400D four-bladed reamer 10 has an identical first arc length AL1 of 90 degrees within the plane P of 90 degrees. In the presented preferred embodiment of the invented six-bladed reamer 500 of FIG. 5A through FIG. 5C, each alternate blade 500E-500J of the six-bladed reamer 500 preferably has an identical-length second arc length AL2 of 60 degrees.

It is understood that each blade arc length AL1-AL2 is measured from a viewpoint extending parallel to the tool centerline 29 wherein the blade arc length AL1-AL2 comprise a measurement of the full extension and length of respectively each observed exemplary blade 400A-400D and alternate blade 500E-500J has the observed exemplary blade 400A-400D and alternate blade 500E-500J extends in a helical or spiral shape along and about the central elongate axis. Each observed exemplary blade 400A-400D and alternate blade 500E-500J is preferably populated with a plurality of alternate invented cutters 216, wherein and whereby each combination of blades of the four exemplary blades 400A-400D or of the six alternate blades 500E-500J preferably provides at least 360 degree coverage by the alternate invented cutters 216 around the circumference 276 of the attached or comprising invented reamer 10 or tool body 12 & 506.

In accordance with the invented method, it is preferred that blade arc length AL1-AL2 span at least along the result of dividing the 360 degree value by the number of blades 400A-400D & 500E-500J of the invented reamer 10 & 500 to which the instant exemplary blade 400A-400D & 500E-500J is coupled, attached or comprised within. More particularly, as shown in FIG. 4B and FIG. 4C, where the four-bladed reamer 10 has or is coupled with a set of the four exemplary blades 400A-400D, the preferred four-blade arc length AL1 90 degrees as measured within the intersecting plane P. Accordingly, and as shown in FIG. 5B and FIG. 5C, where the six-bladed reamer 500 has or is coupled with a six alternate blade set 500E-500J, the preferred six-blade blade arc length AL2 of each of the six alternate blades 500E-500J is 60 degrees as measured within the intersecting plane P.

It is understood that in FIG. 4A through FIG. 5C a plane P that is normal to the tool centerline 29 is presented as intersecting the illustrated tool body 12 & 506, wherein the plane P is defined by an X-axis and a Z-axis and that the X-axis, the Z-axis and the tool centerline 29 are each mutually orthogonal to the other two cited axes X, Z & 29.

It is further understood that in FIG. 4A through FIG. 5C that each element designator W1 and W2 represents a linear blade width W1 and W2 of an indicated blade 400A-400D & 500E-500J wherein each blade width W1 and W2 is measured within the plane P and is thereby measured normal to the tool centerline 29 of each comprising invented tool body 12 & 506. It is also understood that an element designator B1-B2 represents a blade width arc length of an indicated blade 400A-400D & 500E-500J wherein each blade width arc length B1-B2 is measured within the plane P and is thereby normal to the tool centerline 29 of each comprising invented tool body 12 & 506. Each blade width designator B1-B2 presents an arc length measured within the plane P and determined by the magnitude of the linear blade width W1-W2 of the instant blade 400A-400D & 500E-500J.

It is also understood that in certain even alternate preferred embodiments of the invented method that the linear blade widths W1-W2 may vary along a particular blade 400A-400D & 500E-500J as the instant blade 400A-400D & 500E-500J extends along and about the central axis 29; in such cases the longest blade width W1-W2 and the corresponding blade width arc length B1-B2 are applicable to and referenced in the following discussion of the additional embodiments of the invented reamer 10 & 500.

For the sake of illustration of the partial range of the invented method and not offered as a limiting aspect or quality, each blade width length W1-W2 and each corresponding blade width arc length BA1-BA2 is presented in the corresponding FIG. 4A through FIG. 5C as possibly being of different or equivalent magnitudes or dimensions. Also offered for the sake of clarity of explanation and not offered as a limiting aspect or quality, in the FIG. 4A through FIG. 5C all of the blades 400A-400D & 500E-500J of a particular invented reamer 10 & 500 are discussed as having equivalent blade widths W1-W2 and corresponding blade width arc lengths B1-B2.

Referring now to the Figures and particularly to FIG. 4A and FIG. 4B, FIG. 4A is a side view of the four-bladed embodiment of the invented reamer 10 (hereinafter, "the four-bladed reamer" 10) having a plurality of blades 20, that for the sake of clarity of explanation are denoted with distinct elements numbers as a set four individual exemplary blades 400A-400D. The four individual exemplary blades 400A-400D each extend from the tool body 12 and distally away from the tool centerline 29. It is noted that each exemplary blade 400A-400D is coupled with a pair of first linear tapered sections 22 & 23 at each end of the instant four exemplary blades 400A-400D. Furthermore, each of the four exemplary blades 400A-400D are positioned between the four alternate external surface channels 408 (hereinafter, "channels" 408) respectively positioned at each elongated side of the four exemplary blades 400A-400D.

The four exemplary blades 400A-400D each have a substantively equivalent linear first blade width W1 within the plane P and therefore an equivalent corresponding first blade arc length BA1 within the plane P as shown in FIG. 4B. It is understood that the first blade arc length BA1 is defined by the shape and size of the first blade width W1.

FIG. 4B is a representation of a projection view of the surface of the four-bladed reamer 10. The projection view of FIG. 4C presents certain details of the four exemplary blades 400A-400D that are preferably identically sized, shaped and oriented to each other of the four exemplary blades 400A-400D on the surface of the four-bladed reamer 10.

The first exemplary blade 400A of the four exemplary blades 400A-400D present the first arc length AL1 of 90 degrees within the plane P and that extends from the first exemplary blade 400A blade lower left point A1 to a first exemplary blade 400A upper right point A2. The second exemplary blade 400B of the four exemplary blades 400A-400D presents the first arc length AL1 of 90 degrees within the plane P and that extends from a second exemplary blade 400B blade lower left point B1 to a second exemplary blade 400B blade upper right point B2. The third exemplary blade 400C of the four exemplary blades 400A-400D presents the first arc length AL1 of 90 degrees within the plane P and that extends from a third exemplary blade 400C blade lower left point C1 to a third exemplary blades 400C blade upper right point C2. The fourth blade 400D of the four exemplary blades 400A-400D presents the first arc length AL1 of 90 degrees within the plane P and that extends from a fourth exemplary blade 400D blade lower left point D1 to a fourth exemplary blade 400D blade upper right point D2.

Each first arc length AL1 comprise arc sections of one blade arc length BA1 and one first channel arc length CA1. Each first channel arc length CA1 is projected from the displacement between two neighboring exemplary blades 400A-400D of the four exemplary blades 400A-400D. In other words, each of the four channel arc lengths CA1 extend from one of the four channels 408 disposed between two neighboring exemplary blades 400A-400D of the four exemplary blades 400A-400D. It is understood that each first channel arc length CA1 is substantively equal to 360 degrees divided by the count of four of the four exemplary blades 400A-400D minus the first blade arc length BA1, i.e., 90 degrees minus the first blade arc length BA1.

FIG. 4B presents four straight demarcation lines 410-416 that are added to demonstrate the relative positioning of the first arc lengths AL1 within the plane P of each of the four exemplary blades 400A-400D. Each of the four straight demarcation lines 410-416 are preferably parallel to the tool centerline 29. It is understood that the four straight demarcation lines 410-416 are infinitely narrow from the perspective of their traversal though the plane P.

It is understood that the first exemplary blade 400A of the four exemplary blades 400A-400D preferably extends up to but not beyond both (a.) a first demarcation line 410 at the first exemplary blade lower left point A1; and (b.) a second demarcation line 412 at the first exemplary blade upper right point A2.

The second exemplary blade 400B of the four exemplary blades 400A-400D preferably extends up to but not beyond both (a.) the second demarcation line 412 at the second exemplary blade lower left point B1; and (b.) a third demarcation line 414 at the second exemplary blade upper right point B2.

The third exemplary blade 400C of the four exemplary blades 400A-400D preferably extends up to but not beyond both (a.) the third demarcation line 414 at the third exemplary blade lower left point C1; and (b.) a fourth demarcation line 416 at the third exemplary blade upper right point C2.

The fourth blade 400D of the four blade set 400A-400D preferably extends up to but not beyond both (a.) the fourth demarcation line 416 at the fourth exemplary blade lower left point D1; and (b.) the first demarcation line 410 at the fourth exemplary blade upper right point D2.

FIG. 4C is a cut-away top view of the first four-bladed reamer 10, wherein the first exemplary four-blade arc length AL1 of each of the four exemplary blades 400A-400D is shown to be equal to 360 degrees divided by the total count of four the four blades 400A-400D, i.e., four divided into 360 degrees results in the first exemplary arc length AL1 dimension of 90 degrees. It is further understood that each first channel arc length CA1 is shown in FIG. 4C to be substantively equal to 360 degrees divided by the count of four of the four exemplary blades 400A-400D minus the first blade arc length BA1, i.e., 90 degrees minus the first blade arc length BA1.

Referring now to the Figures and particularly to FIG. 5A and FIG. 5B, FIG. 5A is a side view of the alternate invented six-bladed embodiment of the invented reamer 500 (hereinafter, "the six-bladed reamer" 500) having six substantively similar alternate blades 500E-500J coupled with a six-bladed tool body 506. Each of the six alternate blades 500E-500J has a preferably equivalent second blade width W2 and therefore an equivalent corresponding second blade arc length B2 as shown in FIG. 5B. It is understood that each second channel arc length CA2 is substantively equal to 360 degrees divided by the count of six of the alternate blades 500E-500J minus the second blade arc length BA2, i.e., 60 degrees minus the dimension of the second blade arc length BA2.

FIG. 5B is a representation of a projection view of the surface of the six-bladed reamer 500. The projection view of FIG. 5C presents certain details of the six alternate blades 500E-500J, wherein each alternate blade 500E-500J is preferably identically sized, shaped and oriented to each other of the alternate blades 500E-500J on the surface of the six-bladed reamer 500.

The first alternate blade 500E of the six alternate blades 500E-500J presents the second arc length AL2 of 60 degrees within the plane P and that extends first alternate blade lower left point E1 to a first alternate blade upper right point E2. The second alternate blade 500F of the six alternate blades 500E-500J presents the second arc length AL2 of 90 degrees within the plane P and that extends from a second alternate blade lower left point F1 to a second alternate blade upper right point F2. The third alternate blade 500G of the six alternate blades 500E-500J presents the second arc length AL2 of 90 degrees within the plane P and that extends from a third alternate blade lower left point G1 to a third alternate blade upper right point G2. The fourth alternate blade 50011 of the six alternate blades 500E-500J presents the second arc length AL2 of 90 degrees within the plane P and that extends from a fourth alternate blade lower left point H1 to a fourth alternate blade upper right point 112. The fifth alternate blade 500I of the six alternate blades 500E-500J presents the second arc length AL2 of 90 degrees within the plane P and that extends from a fifth alternate blade lower left point I1 to a fifth alternate blade upper right point I2. The sixth alternate blade 500J of the six alternate blades 500E-500J presents the second arc length AL2 of 90 degrees within the plane P and that extends from a sixth alternate blade lower left point J1 to a sixth alternate blade upper right point J2.

Each of the six individual alternate blades 500E-500JD each extend from the alternate tool body 506 and distally away from the tool centerline 29. It is noted that each exemplary six alternate blades 500E-500JD are separately coupled with each of a pair of first linear tapered sections 508 at each end of the instant first exemplary six alternate blades 500E-500JD. Furthermore, each of the exemplary six alternate blades 500E-500JD is positioned between two of the six alternate exterior surface channels 510 (hereinafter, "alternate channels" 508).

The six alternate blades 500E-500JD each have a substantively equivalent linear second blade width W2 within the plane P and therefore an equivalent corresponding second blade arc length BA2 within the plane P as shown in FIG. 5B. It is understood that the second blade arc length BA2 is defined by the shape and size of the second blade width W2.

FIG. 5B additionally presents six additional straight demarcation lines 511-520 that are added to demonstrate the relative positioning of the second arc lengths AL2 within the plane P of each alternate blade 500E-500J. Each of the six additional straight demarcation lines 511-520 are preferably parallel to the tool centerline 29. It is understood that the six straight demarcation lines 511-520 are infinitely narrow from the perspective of their traversal though the plane P.

It is understood that the first alternate blade 500E of the six alternate blades 500E-500J preferably extends up to but not beyond both (a.) a first additional demarcation line 511 at the first alternate blade lower left point E1; and (b.) a second additional demarcation line 512 at the first alternate blade upper right point E2.

The second alternate blade 500F of the six alternate blades 500E-500J preferably extends up to but not beyond both (a.) the second additional demarcation line 512 at the second alternate blade lower left point F1; and (b.) a third additional demarcation line 514 at the second alternate blade upper right point F2.

The third alternate blade 500G of the six alternate blades 500E-500J preferably extends up to but not beyond both (a.) the third additional demarcation line 514 at the third alternate blade lower left point G1; and (b.) a fourth additional demarcation line 516 at the third alternate blade upper right point C2.

The fourth alternate blade 50011 of the six alternate blades 500E-500J preferably extends up to but not beyond both (a.) the fourth additional demarcation line 516 at the fourth alternate blade lower left point H1; and (b.) a fifth additional demarcation line 518 at the fourth alternate blade upper right point 112.

The fifth alternate blade 500I of the six alternate blades 500E-500J preferably extends up to but not beyond both (a.) the fifth additional demarcation line 518 at the fifth alternate blade lower left point IL and (b.) a sixth additional demarcation line 520 at the fifth alternate blade upper right point I2.

The sixth alternate blade 500J of the six alternate blades 500E-500J preferably extends up to but not beyond both (a.) the sixth additional demarcation line 520 at the sixth alternate blade lower left point I1; and (b.) the first additional demarcation line 511 at the sixth alternate blade upper right point I2.

FIG. 5C is a cut-away top view of the six-bladed reamer 500, wherein a second alternate blade arc length AL2 of each of the six alternate blades 500E-500J are shown to be equal to 360 degrees divided by six, or 60 degrees. It is noted that each of the six alternate blades 500E-500J are coupled with an alternate pair of linear tapered sections 508 respectively positioned at each end of two ends of each of the alternate blades 500E-500J. Furthermore, each of the six alternate blades 500E-500J are positioned between two neighboring of the six alternate channels 510. It is further understood that each second channel arc length CA2 is shown in FIG. 5C to be substantively equal to 360 degrees divided by the count of six of the six alternate blades 500E-500J minus the dimension of the second blade arc length BA2, i.e., 60 degrees minus the second blade arc length BA2.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a non-transitory computer-readable medium containing computer program code, which can be executed by a computer processor for performing any or all of the steps, operations, or processes described.

Embodiments of the invention may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the invention may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based herein. Accordingly, the disclosure of the embodiments of the invention is intended to be illustrative, but not limiting, of the scope of the invention, which is set forth in the following claims.

What is claimed is:

1. A reamer comprising:

an annular body having an exterior side, a first open end, a second open end and an interior channel;

the annular body having an elongate interior channel axisymmetrically disposed about a central elongate axis and the elongate interior channel extending fully through and between the first open end and the second open end; and a plurality of cutting inserts arranged in at least two helical segment paths disposed along the exterior side of the annular body, each helical segment path having a series of cutting inserts of the plurality of cutting inserts, each helical segment path extending parallel to and curving around the central elongate axis, and each cutting insert of the plurality of cutting inserts positioned within one of the at least two helical segment paths, and each cutting insert substantively equidistant from the central elongate axis, wherein the plurality of cutting inserts are spaced to present an uninterrupted series of cutting inserts to an axial view parallel to the central elongate axis, and no helical segment path overlaps with any portion of another helical segment path in the axial view parallel to the central elongate axis.

2. The reamer of claim 1, wherein at least one cutting insert comprises tungsten carbide.

3. The reamer of claim 1, wherein at least one cutting insert comprises a center depression in a top side of the at least one cutting insert.

4. The reamer of claim 1, wherein a first grouping cutting inserts of the plurality of cutting inserts are uniformly distributed within a first helical segment path of the at least two helical segment paths.

5. The reamer of claim 4, wherein at least one cutting insert of the first grouping comprises a center depression in a top side of the at least one cutting insert.

6. The reamer of claim 1, wherein a first cutting insert is positioned within a first path of the at least two helical segment paths ("first path") is placed most proximate to the first path's end and a second cutting insert is positioned within the first path most proximate to the second end.

7. The reamer of claim 1, wherein the plurality of cutting inserts are spaced to present a substantively uninterrupted series of cutting inserts to an axial view parallel to the central elongate axis.

8. A reamer comprising:

an annular body having an exterior side, a first open end, a second open end and an elongate interior channel;

the annular body having an elongate interior channel axisymmetrically disposed about a central elongate axis and the elongate interior channel extending fully through and between the first open end and the second open end; and a plurality of cutting inserts arranged in a plurality of helical segment paths disposed along the exterior side of the annular body, each helical segment path extending parallel to and curving around the central elongate axis, and each cutting insert positioned within one of the helical segment paths, and each cutting insert substantively equidistant from the central elongate axis, wherein the plurality of cutting inserts are spaced to present an uninterrupted series of cutting inserts to an axial view parallel to the central elongate axis, and no helical segment path overlaps with any portion of another helical segment path in the axial view parallel to the central elongate axis.

9. The reamer of claim 8, wherein at least one cutting insert comprises tungsten carbide.

10. The reamer of claim 8, wherein at least one cutting insert comprises a center depression in a top side of the at least one cutting insert.

11. The reamer of claim 8, wherein a first grouping cutting inserts of the plurality of cutting inserts are uniformly distributed within a first helical segment path of the at least two helical segment paths.

12. The reamer of claim 11, wherein at least one cutting insert of the first grouping comprises a center depression in a top side of the at least one cutting insert.

13. The reamer of claim 8, wherein a first cutting insert is positioned within a first path of the at least two helical segment paths ("first path") is placed most proximate to the first open end of the annular body and a second cutting insert is positioned within the first path most proximate to the second open end of the annular body, and a first insert center of the first cutting insert is positioned at 360/N degrees from a second insert center of the second cutting insert with respect to the central elongate axis, wherein N is equal to the count of the helical segment paths of the plurality of helical segment paths.

14. The reamer of claim 8, wherein a first cutting insert is positioned within a first path of the at least two helical segment paths ("first path") is placed most proximate to the first open end of the annular body and a second cutting insert is positioned within the first path most proximate to the second open end of the annular body, and a first insert body of the first cutting insert is positioned at 360/N degrees from a second insert center of the second cutting body with respect to the central elongate axis, wherein N is equal to the count of the helical segment paths of the plurality of helical segment paths.

15. The reamer of claim 8, wherein each helical segment path of the plurality of helical segment paths comprises a pair of cutting inserts radially separated at 360/N degrees with respect to the central elongate axis, wherein N is equal to the count of the helical segment paths of the plurality of helical segment paths.

16. The reamer of claim 8, wherein at least a first plurality of cutting inserts of the plurality of cutting inserts is arranged within one of the N helical segment paths and at least two cutting inserts of the first plurality of cutting inserts are positioned to be radially continuous with respect to the central elongate axis, wherein N is equal to the count of the helical segment paths of the plurality of helical segment paths.

17. The reamer of claim 8, further comprising at least one relieved helical section of the exterior side of the annular body, the at least one relieved helical section bordered on either side by a helical segment paths, and the at least one relieved helical section extending parallel to and curving around the central elongate axis, wherein the exterior surface is closer to the central elongate axis along the at least one relieved helical section of in comparison with the N helical segment paths, wherein N is equal to the count of the helical segment paths of the plurality of helical segment paths.

18. The reamer of claim 8, further comprising a first linear tapered section extending from the first open end of the annular body and away from the annular body, and the elongate interior channel extending from the annular body and fully through the first liner tapered section.

19. The reamer of claim 18, further comprising a second linear tapered section extending from the second end of the annular body and away from the annular body, and the elongate interior channel extending from the annular body and fully through the second liner tapered section.

20. The reamer of claim 18, wherein the first liner tapered section comprises an additional plurality of alternate cutting inserts.

21. The reamer of claim 18, wherein at least one alternate cutting insert of the additional plurality of alternate cutting inserts comprises polycrystalline diamond.

22. The reamer of claim 8, wherein the plurality of cutting inserts are spaced to present a substantively uninterrupted series of cutting inserts to an axial view parallel to the central elongate axis.

23. The reamer of claim 22, wherein the plurality of cutting inserts are spaced to present a series of cutting inserts presenting to an axial view parallel to the central elongate axis a substantively continuous series.

* * * * *